US007300219B2

(12) United States Patent
Lee

(10) Patent No.: US 7,300,219 B2
(45) Date of Patent: Nov. 27, 2007

(54) IMAGE FORMING APPARATUS USING THERMAL PRINTING HEAD

(75) Inventor: Yong-duk Lee, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/328,102

(22) Filed: Jan. 10, 2006

(65) Prior Publication Data

US 2006/0263135 A1 Nov. 23, 2006

(30) Foreign Application Priority Data

May 20, 2005 (KR) ..... 10-2005-0042466

(51) Int. Cl.
*B41J 25/304* (2006.01)
*B41J 2/32* (2006.01)

(52) U.S. Cl. ..... 400/120.17; 347/198; 347/197; 400/120.16

(58) Field of Classification Search ..... None
See application file for complete search history.

(56) References Cited

U.S. PATENT DOCUMENTS 5,156,467 A 10/1992 Kitahara et al.
5,181,787 A * 1/1993 Hosomi ..... 400/120.16
5,348,283 A * 9/1994 Yanagi et al. ..... 271/127
5,850,246 A * 12/1998 Maslanka et al. ..... 347/197
5,933,180 A * 8/1999 Ruckl et al. ..... 347/197
6,011,571 A * 1/2000 Lardant et al. ..... 347/197
6,278,472 B1 * 8/2001 Sasaki et al. ..... 347/175
2003/0184640 A1 10/2003 Sasaki

FOREIGN PATENT DOCUMENTS

| | | |
|---|---|---|
| JP | 58-011161 | 1/1983 |
| JP | 59-194878 | 11/1984 |
| JP | 02-235767 | 9/1990 |
| JP | 03-221464 | 9/1991 |
| JP | 05-229149 | 9/1993 |

* cited by examiner

*Primary Examiner*—Daniel J. Colilla
(74) *Attorney, Agent, or Firm*—Roylance, Abrams, Berdo & Goodman, L.L.P.

(57) ABSTRACT

An image forming apparatus that uses a thermal printing head (TPH) is provided. The image forming apparatus includes a platen roller. A TPH unit faces the platen roller and pivots to contact or separate from the platen roller. A first elastic member elastically biases the TPH unit toward the platen roller. A pair of cam levers are provided on both sides of the TPH unit. A pair of rotation cams contact the pair of cam levers and allow the TPH unit to pivot according to a rotation angle of the rotation cams.

16 Claims, 14 Drawing Sheets

IMAGE FORMING APPARATUS USING THERMAL PRINTING HEAD

CROSS-REFERENCE TO RELATED PATENT APPLICATION

This application claims the benefit under 35 U.S.C. § 119(a) of Korean Patent Application No. 10-2005-0042466, filed on May 20, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus that uses a thermal printing head (TPH).

2. Description of the Related Art

A thermal type image forming apparatus includes a thermal printing head (TPH) and a platen roller placed opposite to the TPH. To form a printing nip, the TPH is pressed toward the platen roller by a spring or the like. When a printing medium passes through the printing nip, the TPH prints an image on the printing medium by applying heat to the medium. The platen roller can be used as a main transfer means for transferring the printing medium at a predetermined printing speed. In addition, when a special transfer unit is provided for transferring the printing medium at the predetermined printing speed, the platen roller is rotated by a contact force generated between the printing medium and the platen roller. In this case, when the printing medium is supplied to the TPH and the platen roller, the TPH and the platen roller must be separated from each other. In addition, when printing is performed, the TPH must be pressed toward the platen roller.

To print an image on both sides of the printing medium (that is, duplex printing), two TPHs placed on the opposite sides of the printing mediums may be used, but the price of the image forming apparatus increases when two TPHs are used. Alternatively, duplex printing can be performed by using one TPH and bringing the TPH into opposition with first and second sides of a printing medium, sequentially. In this case, the TPH can be fixed while the printing medium is flipped over, or the TPH can be moved between opposite positions with respect to the first and second sides of the printing medium.

SUMMARY OF THE INVENTION

An aspect of the present invention is to address at least the above problems and/or disadvantages and to provide at least the advantages described below. Accordingly, an aspect of the present invention is to provide a thermal type image forming apparatus that can make a thermal printing head (TPH) contact or separate from a platen roller. In addition, it is an aspect of the present invention to provide a thermal type image forming apparatus that can perform duplex printing by orderly transferring a TPH to opposite positions with respect to first and second sides of a printing medium.

According to an aspect of the present invention, an image forming apparatus includes a platen roller, a TPH unit facing the platen roller which pivots to contact or separate from the platen roller, a first elastic member which elastically biases the TPH unit toward the platen roller, a pair of cam levers provided in both sides of the TPH unit, and a pair of rotation cams which contact the pair of cam levers and allows the TPH unit to pivot according to a rotation angle thereof.

To initiate a phase of the pair of rotation cams, at least one of the pair of the rotation cams may include a stopper which is caught by the cam lever at a position where the TPH unit is separated form the platen roller by a maximum gap.

In addition, the apparatus may further comprise a cam motor rotating the rotation cam, and a metering means detecting a current applied to the cam motor. The phase of the rotation cam may be initiated when a current value rises when the stopper is caught by the cam lever.

In addition, the apparatus may further comprise a cam motor rotating the rotation cam, and an encoder generating a signal proportional to a rotation angle of the cam motor. The phase of the rotation cam may be initiated when the signal of the encoder is not generated when the stopper is caught by the cam lever.

In addition, the apparatus may further comprise a transfer unit for transferring a printing medium, and a driving motor for driving the transfer unit. The platen roller may be rotated by a contact force generated between the printing medium and the platen roller.

In addition, the TPH unit may be transferred to first and second positions to respectively face first and second sides of the printing medium.

In addition, the apparatus may further comprise a knock-up plate on which the printing medium is accommodated, a pick-up roller which picks up the printing medium, being placed separated from the printing medium, a transfer unit for transferring the printing medium, and a driving motor for driving the transfer unit and the pick-up roller. The knock-up plate may be transferred to a pick-up position where the printing medium accommodated thereon contacts the pick-up roller, and to a stand-by position where the printing medium accommodated thereon is separated from the pick-up roller.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

An image forming apparatus according to an exemplary embodiment of the present invention will be now described in detail with reference to the accompanying drawings.

Figure 1:
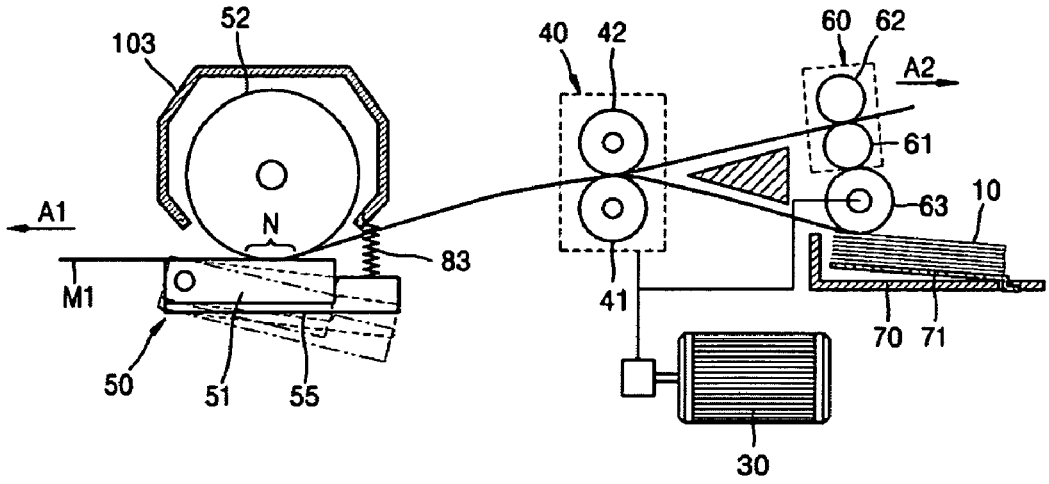
FIGS. 1 and 2 are structural block diagrams of a thermal type image forming apparatus that performs duplex printing according to an exemplary embodiment of the present invention.

FIG. 1 is a block diagram illustrating the image forming apparatus according to the exemplary embodiment of the present invention, which includes a thermal printing head (TPH) 51 and a platen roller 52. A first elastic member 83 pushes the TPH 51 toward the platen roller 52, and the platen roller 52 contacts the TPH 51 to form a printing nip N. A knock-up plate 71 is pivotable installed in a cassette 70. A printing medium 10 is placed on the knock-up plate 71. A pick-up roller 63 for picking up the printing medium 10 is installed at the front side of the knock-up plate 71. A transfer unit 40 transfers the printing medium 10 in first and second directions A1 and A2. The transfer unit 40 includes a transfer roller 41 and an idle roller 42 engaged with the transfer roller 41. A discharging unit 60, which discharges the printing medium 10, includes a discharging roller 61, which rotates in engagement with the pick-up roller 63, and an idle roller 62 engaged with the discharging roller 61. The platen roller 52 is not connected to a driving motor 30. The platen roller 52 contacts the printing medium 10 and rotates as the printing medium 10 is transferred by the transfer unit 40. According to the aforementioned structure of the invention, because the driving motor 30 is provided only to rotate the transfer unit 40 and the pick-up roller 63, a power connection structure is simplified.

A rotating force of the driving motor 30 is not directly transferred to the platen roller 52. Thus, the TPH 51 and the platen roller 52 must be separated from each other when the printing medium 10 is transferred in the first direction A1 and supplied between the TPH 51 and the platen roller 52. Preferably, to prevent damage to the printing medium 10, no force is applied on the printing medium when printing is not performed. Therefore, even if the platen roller 52 is connected to the driving motor 30, the TPH 51 and the platen roller 52 are preferably separated from each other when the printing medium 10 is transferred in the first direction A1 and supplied between the TPH 51 and the platen roller 52. In addition, when the printing medium 10 is transferred in the second direction A2, the printing nip N is preferably formed by using an elastic force of the first elastic member 83.

To transfer the printing medium 10 in the first and second directions A1 and A2, the driving motor 30 is forwardly or reversely rotated. In addition, because the pick-up roller 63 is connected to the driving motor 30, the pick-up roller 63 continuously rotates when the driving motor 30 is rotating. Therefore, the printing medium 10 placed on the knock-up plate 71 must be in contact with the pick-up roller 63 only when the pick-up process is performed, while the printing medium 10 placed on the knock-up plate 71 must be separated from the pick-up roller 63 when the pick-up process is completed. To this end, the knock-up plate 71 is pivoted to a pick-up position where the printing medium 10 is in contact with the pick-up roller 63, and to a stand-by position where the printing medium 10 is separated from the pick-up roller 63 (shown in FIG. 2).

The TPH 51, which is placed opposite to the platen roller 52, has a contact position where the TPH 51 contacts the platen roller 52 to form the printing nip N, a first open position where the TPH 51 is separated from the platen roller 52 by a first gap, and a second open position where the TPH 51 is separated from the platen roller 52 by a second gap which is greater than the first gap. The knock-up plate 71 is positioned in the pick-up position when the TPH 51 is positioned in the second open position, while it is positioned in the stand-by position when the TPH 51 is positioned in the contact position or the first open position.

To perform duplex printing using the TPH 51, the TPH 51 is transferred to a first position (shown in FIG. 1), which is opposite position to a first side M1 of the printing medium 10, and a second position (shown in FIG. 2), which is opposite position to a second side M2 of the printing medium 10.

Figure 3:
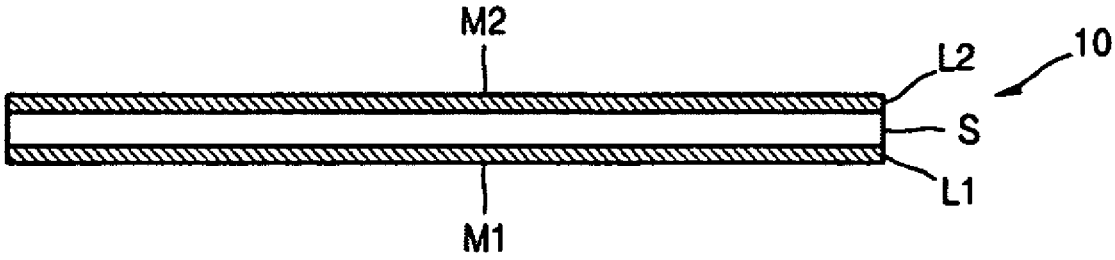
FIG. 3 is a sectional view of an example of a printing medium used in the present invention.

The medium 10 may have a structure as illustrated in FIG. 3. Referring to FIG. 3, ink layers L1 and L2 with predetermined colors are formed on both surfaces of a base sheet S, which are first and second surfaces M1 and M2, respectively. The ink layers L1 and L2 may include a single layer for representing a single color, or multiple layers for representing two or more colors. For example, the ink layer L1 on the first surface M1 of the base sheet S may be formed of two layers to express the colors yellow Y and magenta M, and the ink layer L2 on the second surface M2 thereof may be formed of a single layer to express the color cyan C. The ink layers L1 and L2 may represent identical colors. These descriptions are given as examples, and the present invention is not limited by the structure of the ink layers of the first and second surfaces M1 and M2 of the printing medium 10.

If the base sheet S is transparent, an opaque film may be formed on one of the ink layers L1 and L2, for example, the ink layer L1. The TPH 51 is located at a first position and prints images with Y and M colors by heating the ink layer L1. The TPH 51 is located at a second position and prints an image with a C color by heating the ink layer L2. A complete color image in which the Y, M. and C color images overlap can be recognized when the image is viewed from the side of the base sheet S on which the ink layer L2 is formed. On the other hand, if the base sheet S is opaque, and identical color ink layers are formed on the first and second surfaces M1 and M2, double-sided printing is possible by printing different images on the first and second surfaces M1 and M2 of the medium 10.

Figure 2:
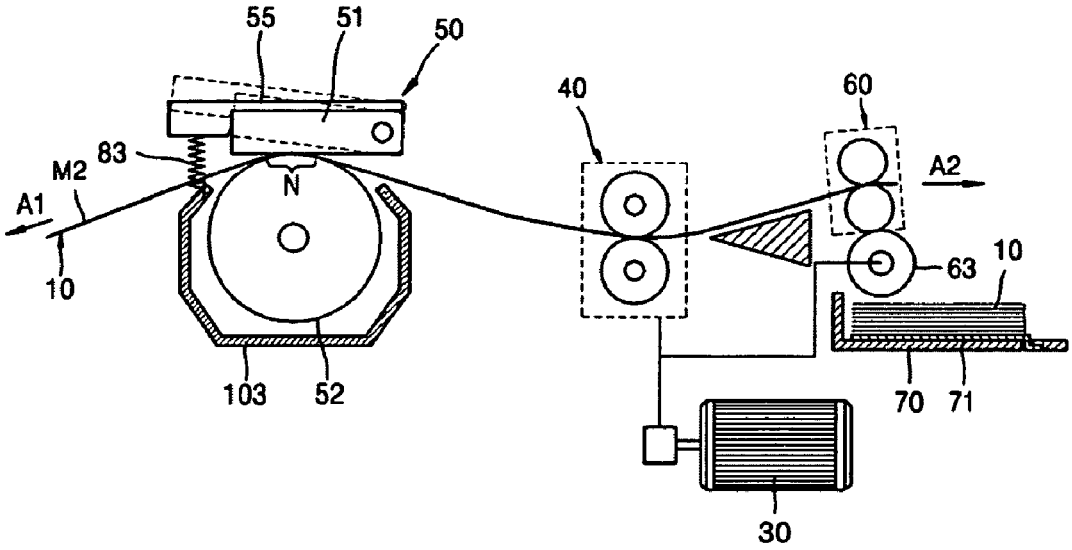
Figure 4:
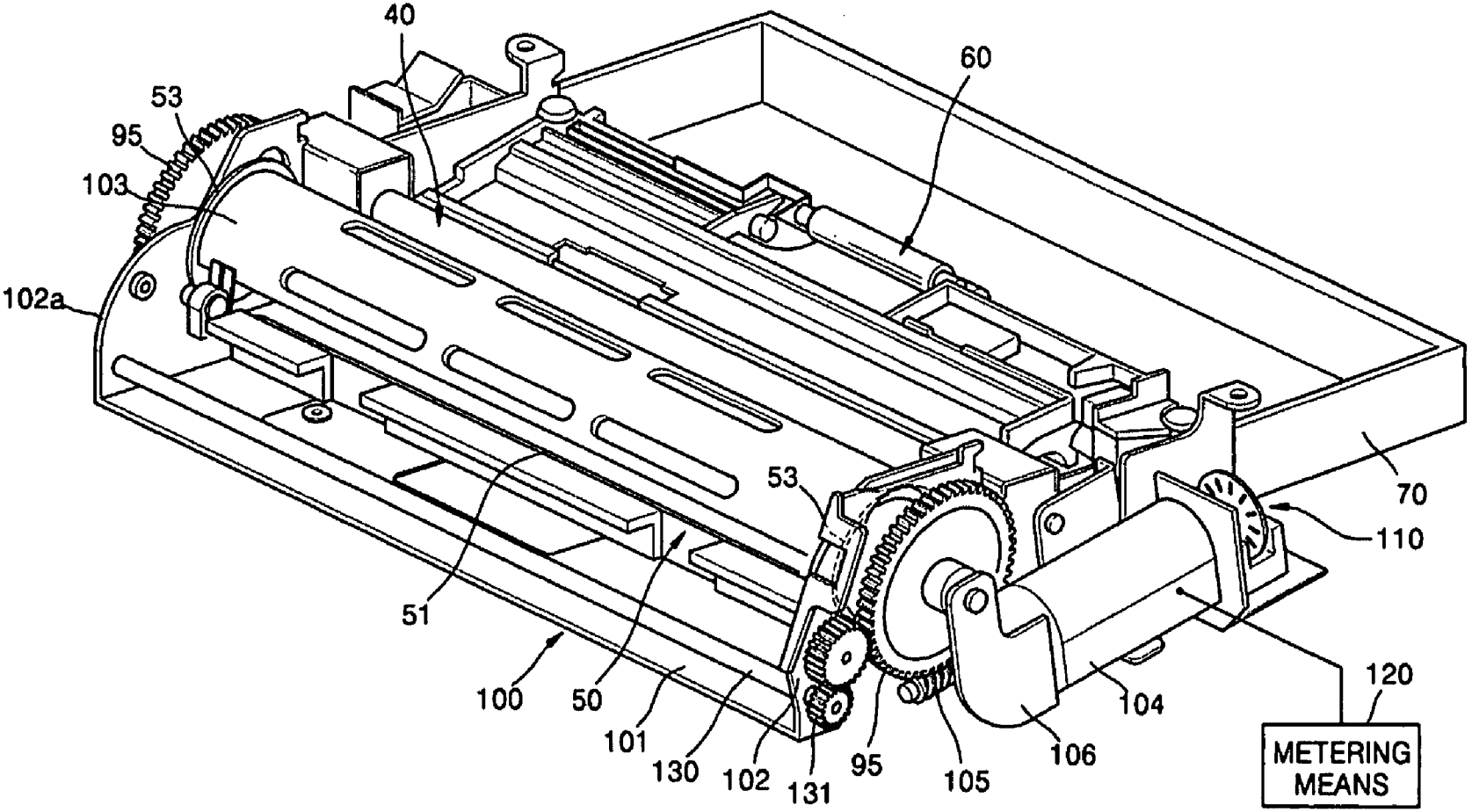
FIG. 4 is a perspective view of the thermal type image forming apparatus according to an exemplary embodiment of the present invention.
Figure 5:
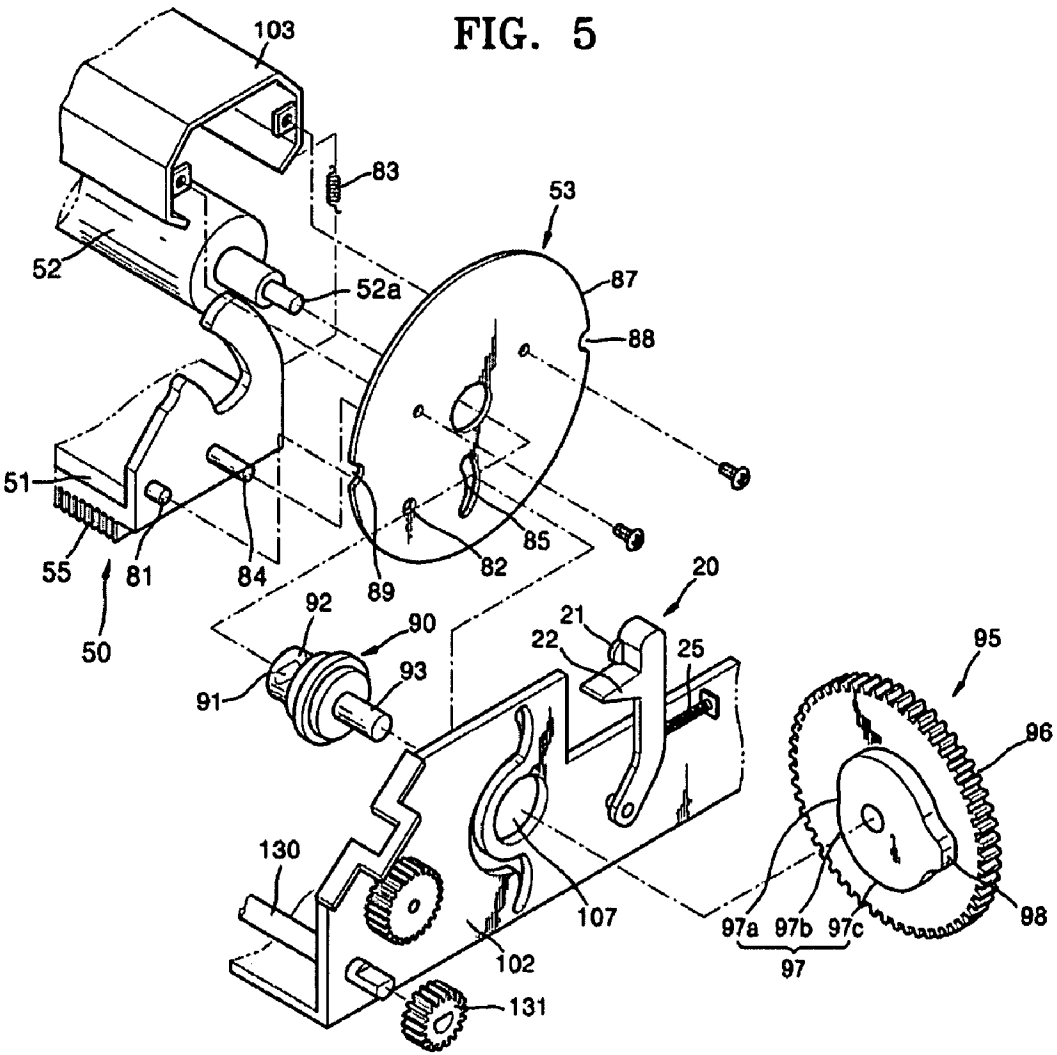
FIG. 5 is a partially exploded perspective view of a thermal type image forming apparatus according to an exemplary embodiment of the present invention.

FIGS. 4 and 5 are a perspective view and a partially exploded perspective view of the thermal type image forming apparatus shown in FIGS. 1 and 2. A frame 100 includes a base 101 in a lower part thereof and two side-plates 102 and 102*a* which are vertically positioned along both sides thereof. The TPH unit 50, the transfer unit 40, the discharging unit 60, and the cassette 70 are installed in the frame 100. Although not shown, the driving motor 30 (shown in FIGS. 1 and 2) may be joined with the side-plate 102*a*.

The TPH unit 50 includes the TPH 51 and a holder 55 which supports the TPH 51. The holder 55 may additionally function as a heat sink for dissipating heat generated from the TPH 51. A hinge shaft 81 and a cam lever 84 are provided on both sides of the holder 55.

Bushings 90 are joined in a hole 107 in the side-plates 102 and 102*a*. The bushings 90 include an inner circumference 91 and a first outer circumference 92. Both ends 52*a* of the platen roller 52 are inserted into the inner circumference 91 of the two bushings 90 joined with the side-plates 102 and 102*a*. A pair of supporting brackets 53 are joined in the first outer circumference 92 of the two bushings 90 to be capable of rotating. The hinge shaft 81 is inserted into a hinge hole 82 included in the pair of the supporting brackets 53. The TPH unit 50 is joined with the pair of supporting brackets 53 in a rotatable manner around the hinge hole 82. A rotation guide 103 is joined with the pair of the supporting brackets 53. The rotation guide 103 guides the printing medium 10, which is supplied from the transfer unit 40, to a position between the TPH 51 and the platen roller 52.

The TPH 51 is elastically biased by the first elastic member 83 in a direction of contacting the platen roller 52. Referring to FIG. 5, for example, a tensile coil spring may be used as the first elastic member 83, one end of which is in contact with the holder 55 and other end of which is in contact with the cover 103 for covering the platen roller 52. The cam lever 84 is inserted into a through-hole 85 included in the supporting bracket 53. To allow the TPH unit 50 to pivot, the through-hole 85 preferably has a circular arc shape whose center is at the hinge hole 82.

The bushings 90 further include a second outer circumference 93 which is coaxial with the first outer circumference 92. A pair of rotation cams 95 are rotatably joined in the second outer circumference 93 of the two bushings 90. The pair of rotation cams 95 includes a gear 96 and a cam 97 which is in contact with the cam lever 84. The cam 97 includes first, second, and third cam surfaces 97*a*, 97*b*, and 97*c* and is eccentrically disposed with respect to the rotation axis of the rotation cam 96. The first, second, and third cam surfaces 97*a*, 97*b*, and 97*c* correspond to the contact position, the first open position, and the second open position of the TPH 51, respectively. A stopper 98 is included on one of or both of the pair of rotation cams 95. A cam motor 104 includes a worm gear 105 which is engaged with the gear 96. A bracket 106, which is joined with the cam motor 104, is joined with the side-plate 102. Accordingly, the pair of supporting brackets 53 and the pair of rotation cams 95 have the same rotation axis.

An encoder 110 generates a signal proportional to the rotation angles of the cam motor 104. The image forming apparatus may further include a metering means which measures a current applied to the cam motor 104.

A pair of gears 131, which are engaged with the gears 96 of the pair of rotation cams 95, respectively, are joined to both ends of a shaft 130. Accordingly, when the cam motor 104 rotates, the pair of rotation cams 95 also rotate.

The supporting bracket 53 has a circular outer circumference 87. First and second joining notches 88 and 89, which are separated from each other by about 180 degrees, are formed on the outer circumference 87. A locking member 20 is rotatably joined to the side-plate 102. A second elastic member 25 provides the locking member 20 with an elastic force in a direction where the locking member 20 joins with the first and second joining notches 88 and 89. The locking member 20 is joined with the first and second joining notches 88 and 89 by the elastic force of the second elastic member 25 and is separated from the first and second joining notches 88 and 89 by the rotation cam 95. The locking member 20 includes a protrusion 21, which is joined with the first and second joining notches 88 and 89, and a snag 22, which interferes with a cam portion 97 of the rotation cam 95. The locking member 20 and the second elastic member 25 may be provided on the side-plate 102*a*.

Figure 6:
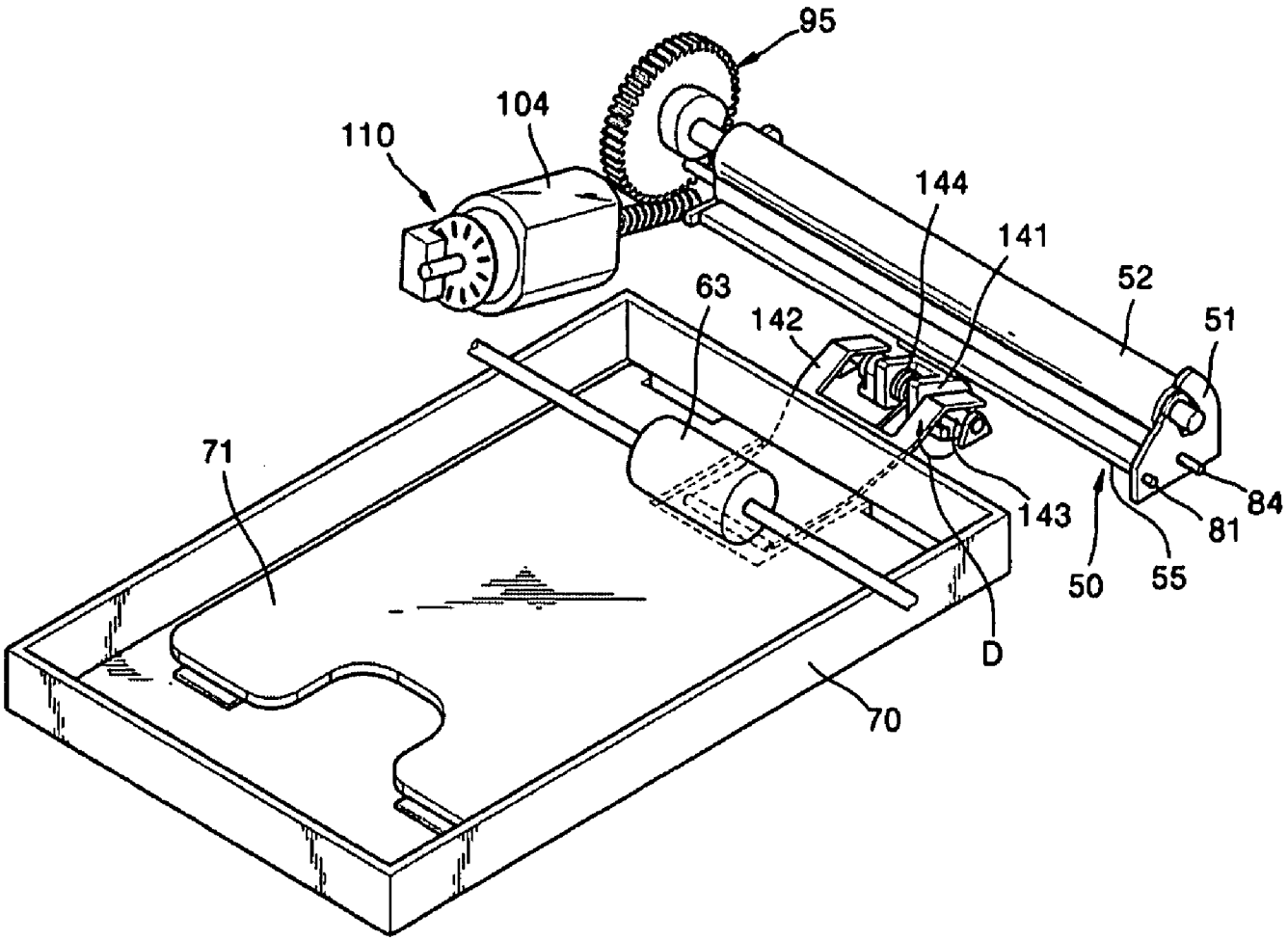
FIG. 6 is an exploded perspective view of a unit for lifting a knock-up plate toward pick-up and stand-by positions according to an exemplary embodiment of the present invention.

FIG. 6 is an exploded perspective view of a unit for lifting the knock-up plate 71. Here, the supporting bracket 53 is not shown, and a single rotation cam 95 is shown. First and second arms 141 and 142 are rotatably installed on a shaft 143. The first arm 141 is extended downward to the TPH unit 50. The second arm 142 is extended downward to the knock-up plate 71. A torsion spring 144 (a third elastic member) elastically connects the first and second arms 141 and 142. One end of the torsion spring 144 is supported by the first arm 141, and the other end is supported by the second arm 142. When the TPH 51 pivots from the contact position toward the first open position, the first arm 141 does not contact the holder 55. When the TPH 51 pivots toward the second open position, the holder 55 pushes the first arm 141. As a result, the first arm 141, the torsion spring 144, and the second arm 142 are rotated toward a direction indicated by an arrow D in FIG. 6. The second arm 142 pushes the knock-up plate 71 up to the pick-up roller 63. The printing medium 10, which is kept on the knock-up plate 71, elastically contacts the pick-up roller 63 by an elastic force of the torsion spring 144. When the TPH 51 pivots from the second open position toward the first open position, the first and second arms 141 and 142 and the torsion spring 144 are returned to their original positions due to the weight of the knock-up plate 71 and the printing medium 10 placed on the knock-up plate.

The phase of the rotation cam 96 has to be checked when the image forming apparatus is turned on or when the image forming apparatus receives a printing instruction from a host (not shown). To this end, the rotation cam 95 is rotated by driving the cam motor 104.

Figure 7A:
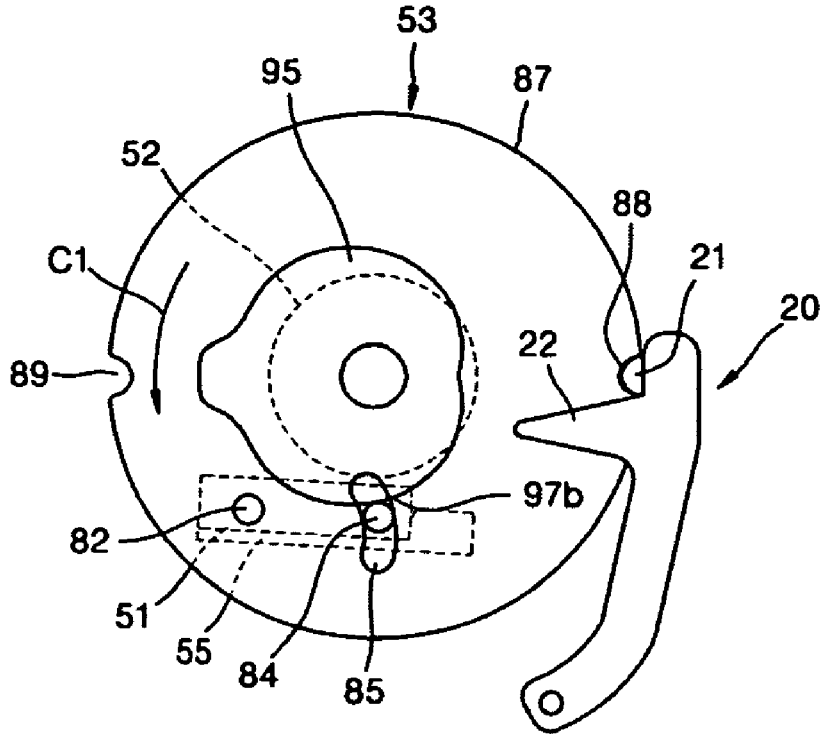
FIG. 7A to D are views of a process of initiating a motion of a rotation cam.
Figure 7B:
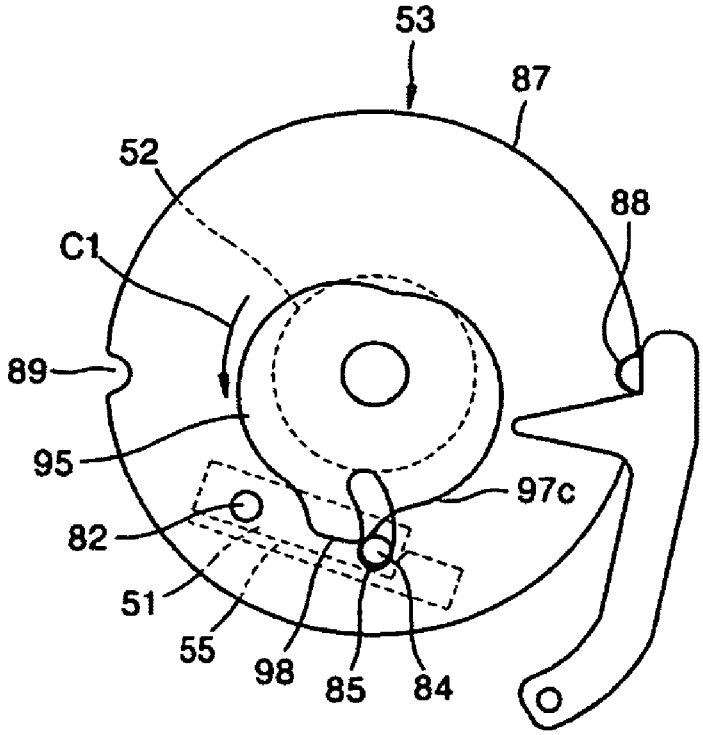

Referring to FIG. 7A, for example, when the image forming apparatus is turned on, the TPH 51 is positioned in the first position and the first open position. When the rotation cam 95 is rotated toward a direction C1, because the locking lever 20 is joined with the first joining notch 88, the supporting bracket 53 is not rotated and the third surface 97*c* of the rotation cam 95 pushes the cam lever 84. The TPH 51 pivots toward the second open position. Referring to FIG. 7B, when the rotation cam 95 continues to rotate, the stopper 98 contacts the cam lever 84, and the TPH 51 is no longer able to pivot because the TPH 51 reaches a maximum open position. Therefore, the rotation cam 95 is no longer able to be rotated either.

Figure 7C:
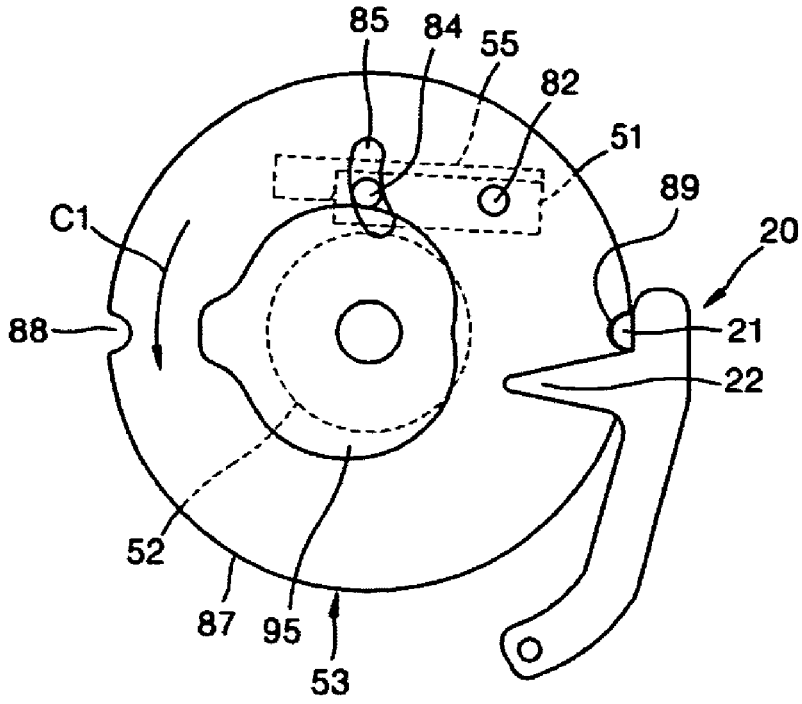
Figure 7D:
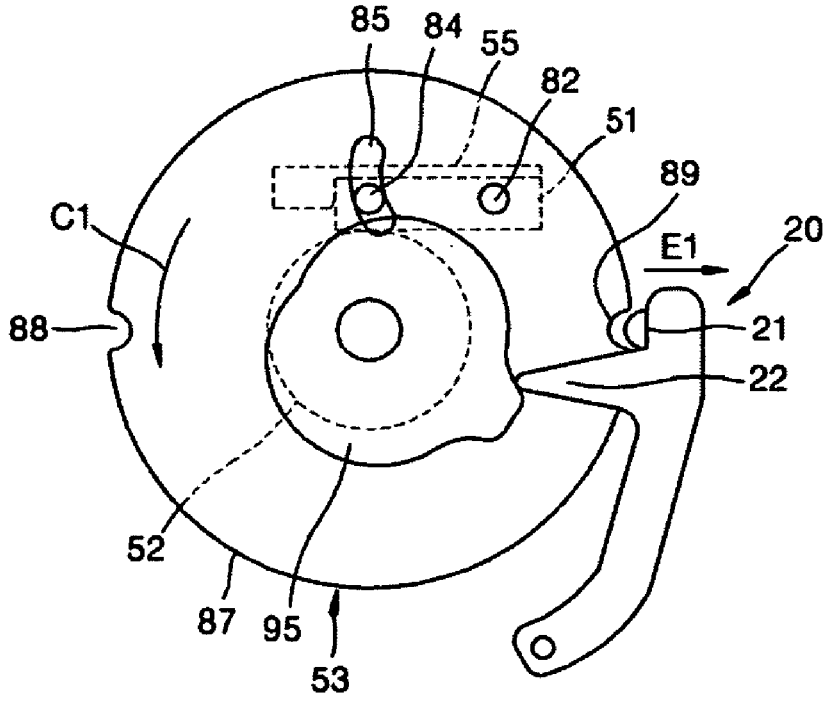

Referring to FIG. 7C, as another example, when the image forming apparatus is turned on, the TPH 51 is positioned in the second position and first open position. When the rotation cam 95 is rotated toward the direction C1, because the locking lever 20 is joined with the second joining notch 89, the supporting bracket 53 is not rotated and the TPH 51 pivots toward the contact position. Referring to FIG. 7D, when the rotation cam 95 continues to rotate, the rotation cam 95 separates the locking member 20 from the second joining notch 89. As a result, as the rotation cam 95 rotates, the supporting bracket 53 is also rotated toward the direction C1, and the TPH 51 rotates around the platen roller 52 to be positioned in the first position as shown in FIG. 7A. The locking member 20 is joined with the first joining notch 88 by the elastic force of the second elastic member 25 and the supporting bracket 53 is no longer rotated. Although the rotation cam 95 continues to rotate and, as shown in FIG. 7B, when the stopper contacts the cam lever 84, the rotation cam 95 is no longer able to rotate.

Accordingly, when the rotation cam 95 is no longer able to rotate, a load imposed on the cam motor 104 increases, which leads to a sharp rise in a current value. Changes in the current value can be measured by using the metering means 120 to determine whether or not the stopper 98 of the rotation cam 95 contacts the cam lever 84. Alternatively, when the rotation cam 92 is no longer rotated, a signal of the encoder 110 is not generated. When the signal of the encoder 110 is not generated during a predetermined period even though current is continuously applied to the cam motor 104, it can be determined that the stopper 98 of the rotation cam 95 and the cam lever 84 are in contact with each other.

As described above, by detecting a contact status between the stopper 98 and the cam lever 84, the phase of the rotation cam 95 is initiated. The operation of initiating the phase of the rotation cam 95 can be performed when the image forming apparatus is turned on. In addition, to reduce operational errors, it can be performed any time before a printing operation is carried out.

Referring now to FIGS. 1, 2, 3 to 6, and 8A to 8G, the printing operation will be described.

Figure 8A:
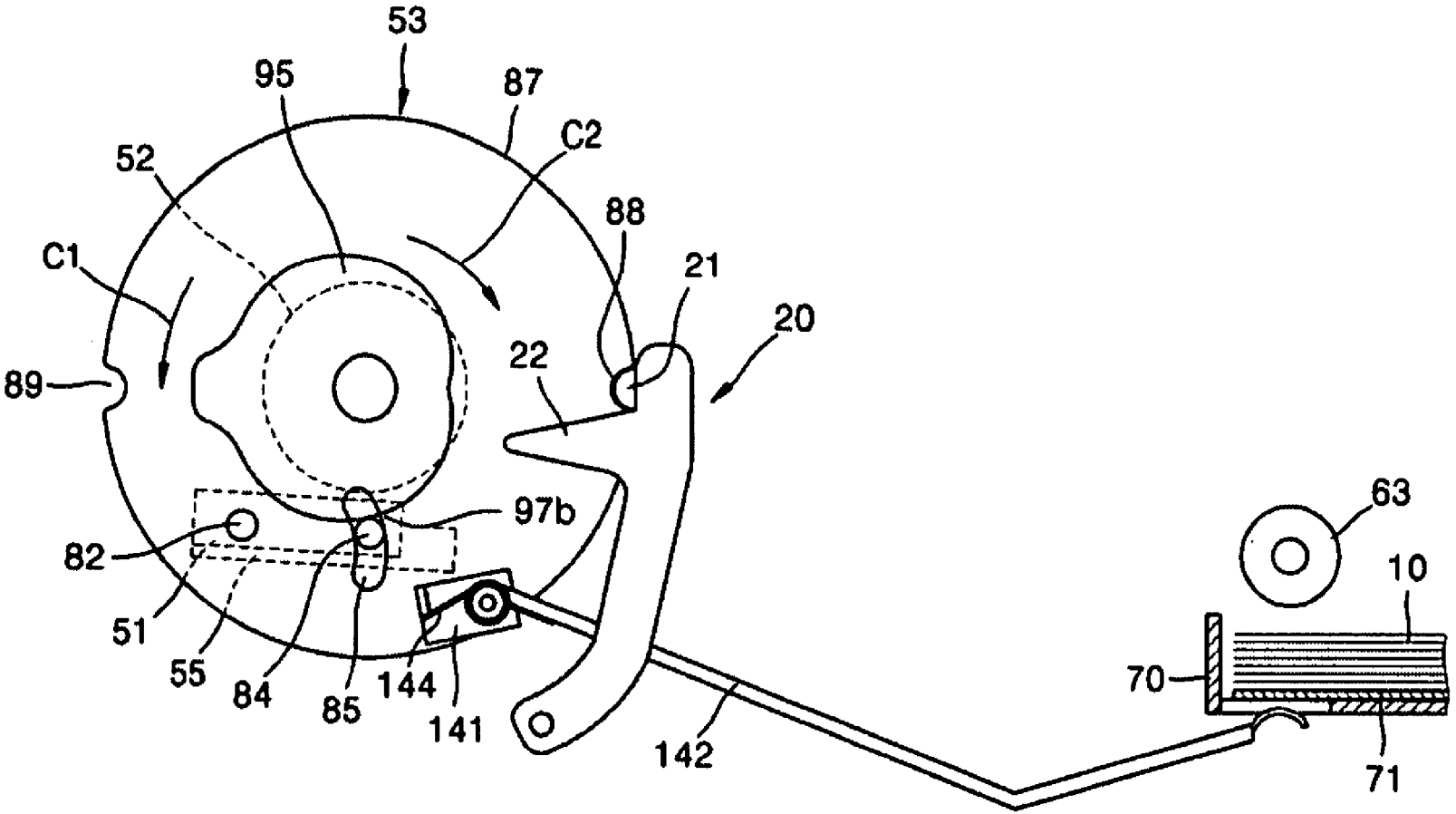
FIG. 8A to G are views of a process of printing an image on both sides of the printing medium.

When the image forming apparatus is turned on according to the aforementioned process, the phase of the rotation cam 95 is initiated and then halted in a position, such as a position shown in FIG. 8A. Referring to FIG. 8A, the cam lever 84 contacts the second cam surface 97*b*. As a result, the TPH 51 is positioned at the first open position, wherein it is separated from the platen roller 52 by a first gap. In addition, as the protrusion 21 of the locking member 20 is caught in the first joining notch 88, the TPH 51 is locked in the first position. Further, the first arm 21 is separated from the holder 55, the knock-up plate 71 is in a lower position, and the printing medium 10 is separated from the pick-up roller 63.

Figure 8B:
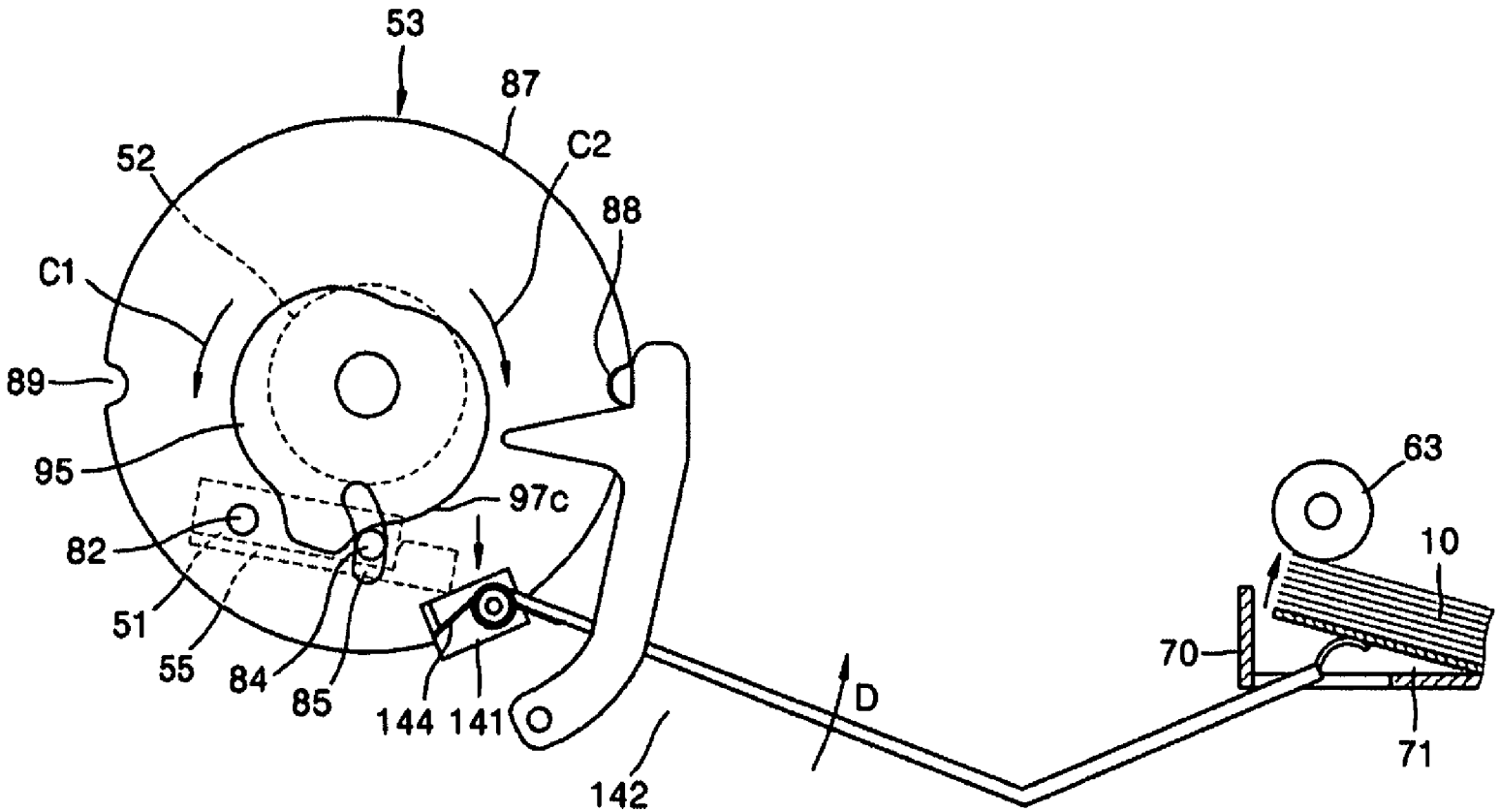

To pick up the printing medium 10, referring to FIG. 8B, the rotation cam 95 is rotated toward the direction C1. Since the supporting bracket 53 is locked by the locking member 20, the supporting bracket 53 is not rotated. The third cam surface 97*c* pushes the cam lever 84 so that the TPH 51 pivots toward the second open position, wherein it is separated from the platen roller 52 by the second gap. Here, the holder 55 pushes the first arm 21 so that the first and second arms 21 and 22 are rotated toward a direction D. The second arm 22 pushes the knock-up plate 71 up toward the pick-up roller 63. The knock-up plate 71 is positioned in the pick-up position. The printing medium 10, which is placed on the knock-up plate 71, elastically contacts the pick-up roller 63 by the elastic force of the torsion spring 144.

The pick-up roller 63 extracts the printing medium 10 from the cassette 70 and the printing medium 10 is moved toward the transfer unit 40. When the printing medium 10 is moved toward a transferable position by the transfer unit 40, the rotation cam 95 is again rotated toward a direction C2. Then, the TPH 51, the first and second arms 21 and 22, and the knock-up plate 71 are returned to the positions shown in FIG. 8A.

The transfer unit 40 transfers the printing medium 10 through the first gap to a position between the TPH 51 and the platen roller 52. As the pick-up roller 63 and the printing medium 10, which is placed on the knock-up plate 71, are separated from each other, the printing medium 10 is not picked up even when the pick-up roller 63 is rotated. Then the transfer unit 40 is halted before a terminal end of the printing medium 10 is completely out of the transfer unit 40.

Figure 8C:
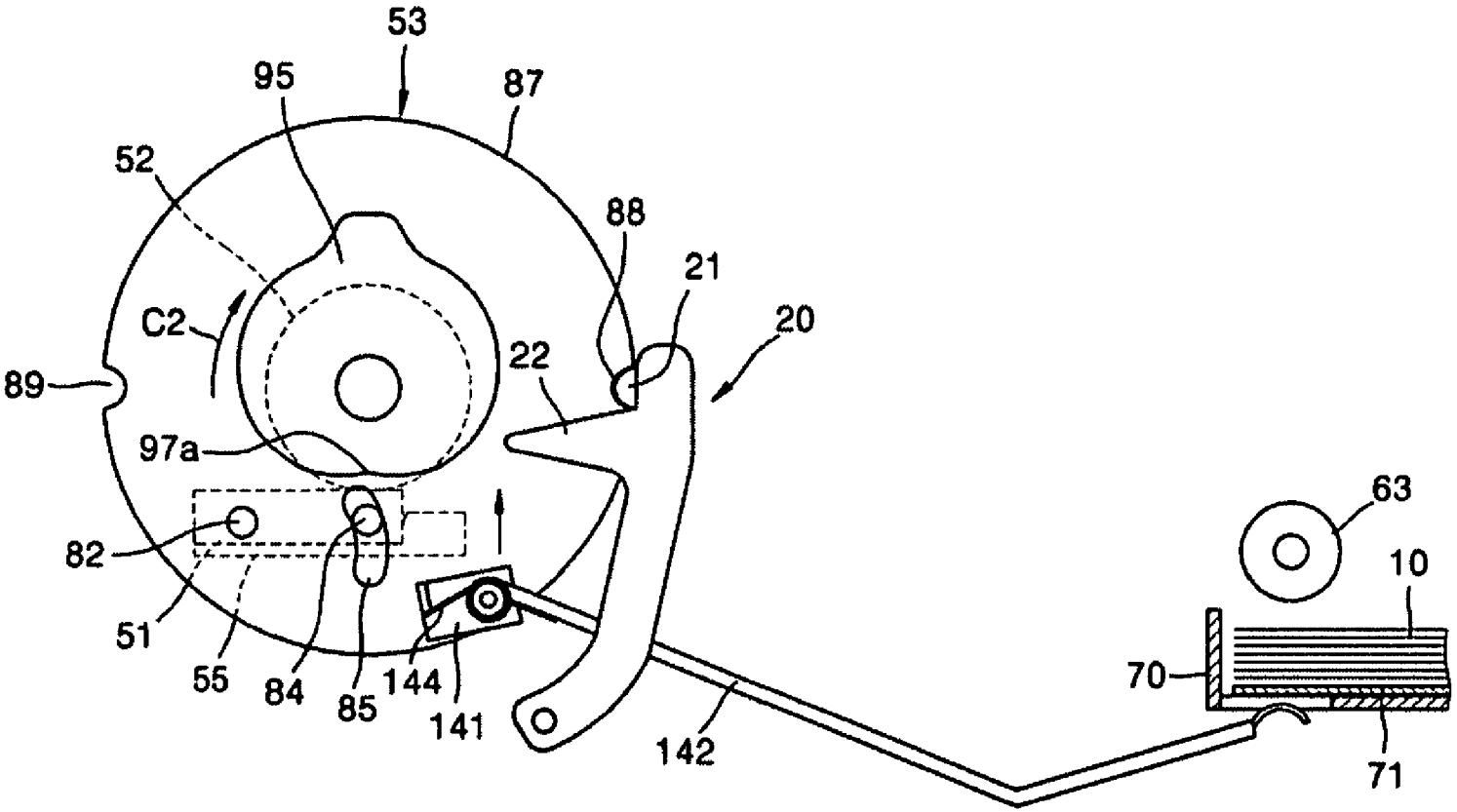

To pivot the TPH 51 toward the contact position, the rotation cam 95 is rotated toward the direction C2 in a state shown in FIG. 8A. Since the protrusion 21 of the locking member 20 is joined with the first joining notch 88, the supporting bracket 53 is not rotated. The cam lever 84 faces the first cam surface 97*a*. The TPH 51 is pivoted around the hinge hole 82 by the elastic force of the first elastic member 83 so that it is positioned in the contact position where the printing medium 10 is pushed toward the platen roller 52, as shown in FIG. 8C. Here, the first cam surface 97*a* and the cam lever 84 are preferably separated from each other. The transfer unit 40 transfers the printing medium 10 in the second direction A2. The TPH 51 prints an image by heating the first side M1 of the printing medium 10. The discharging unit 60 temporarily discharges the printing medium 10 on which the image is printed on the first side M1. When the printing process of the first side M1 of the printing medium 10 is completed, the transfer unit 40 and the discharging unit 60 are halted. Here, the printing medium 10 is completely out of the TPH 51 and the platen roller 52, and is caught in the transfer unit 40 and the discharging unit 60.

Figure 8D:
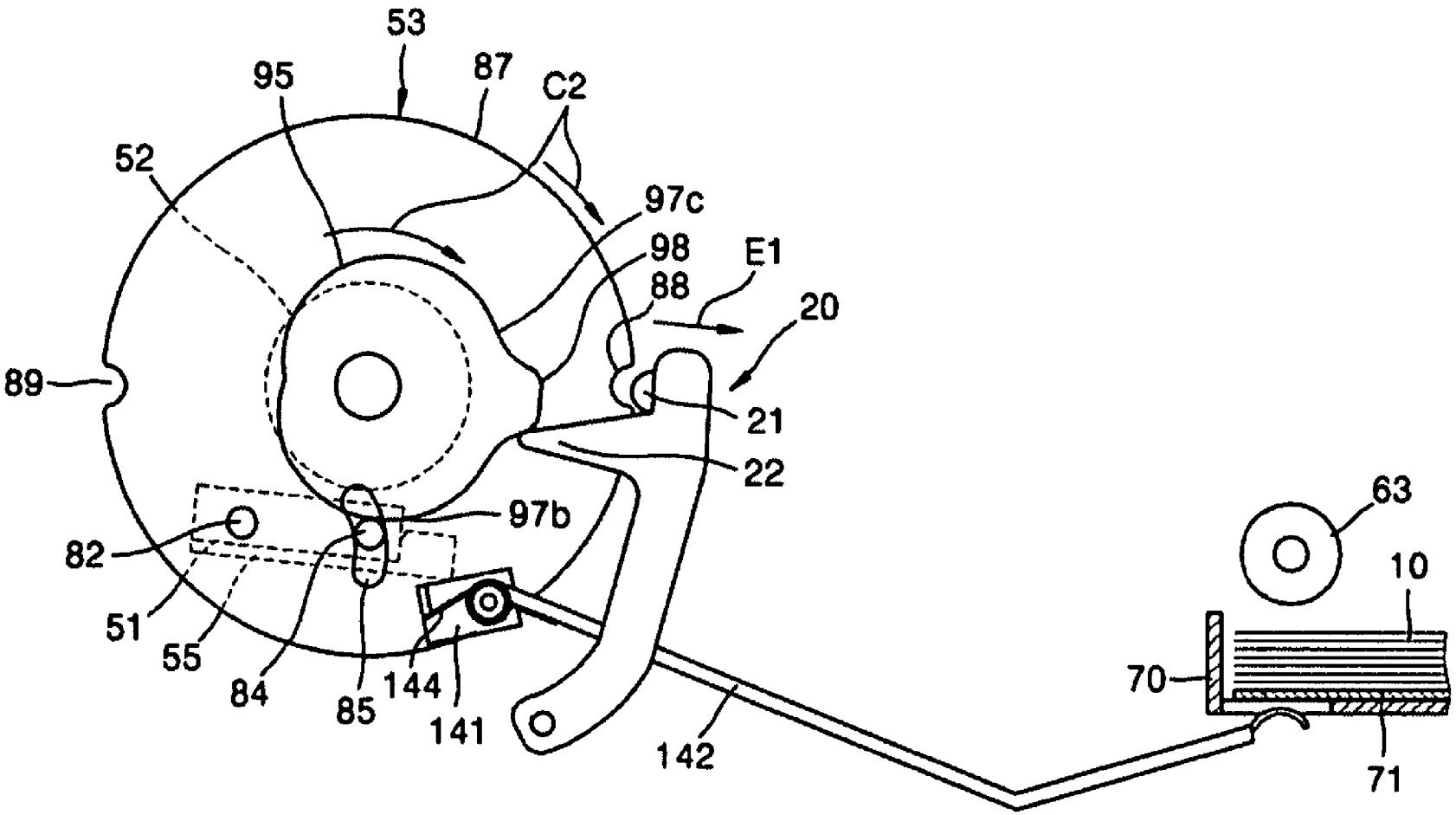
Figure 8E:
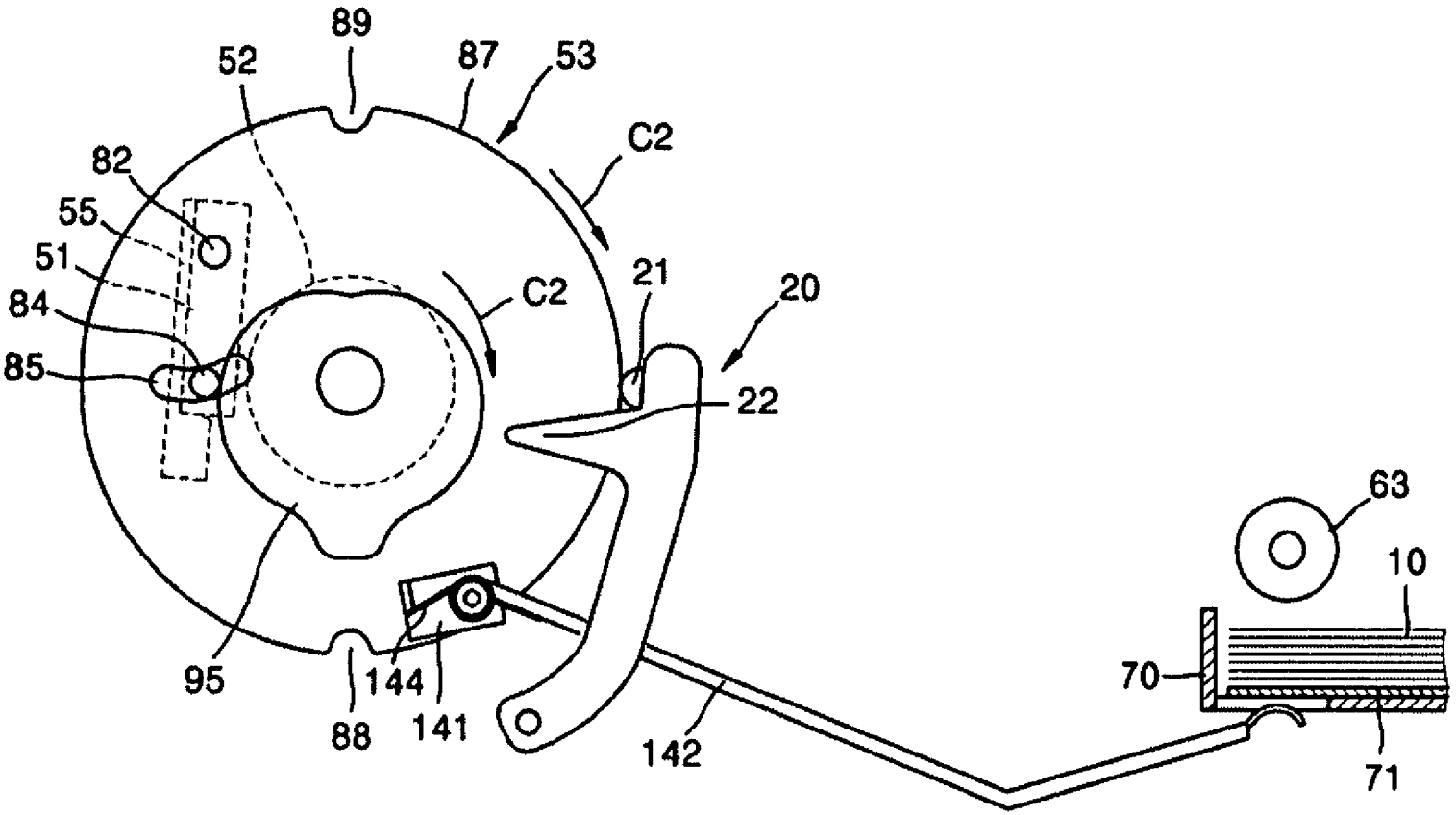
Figure 8F:
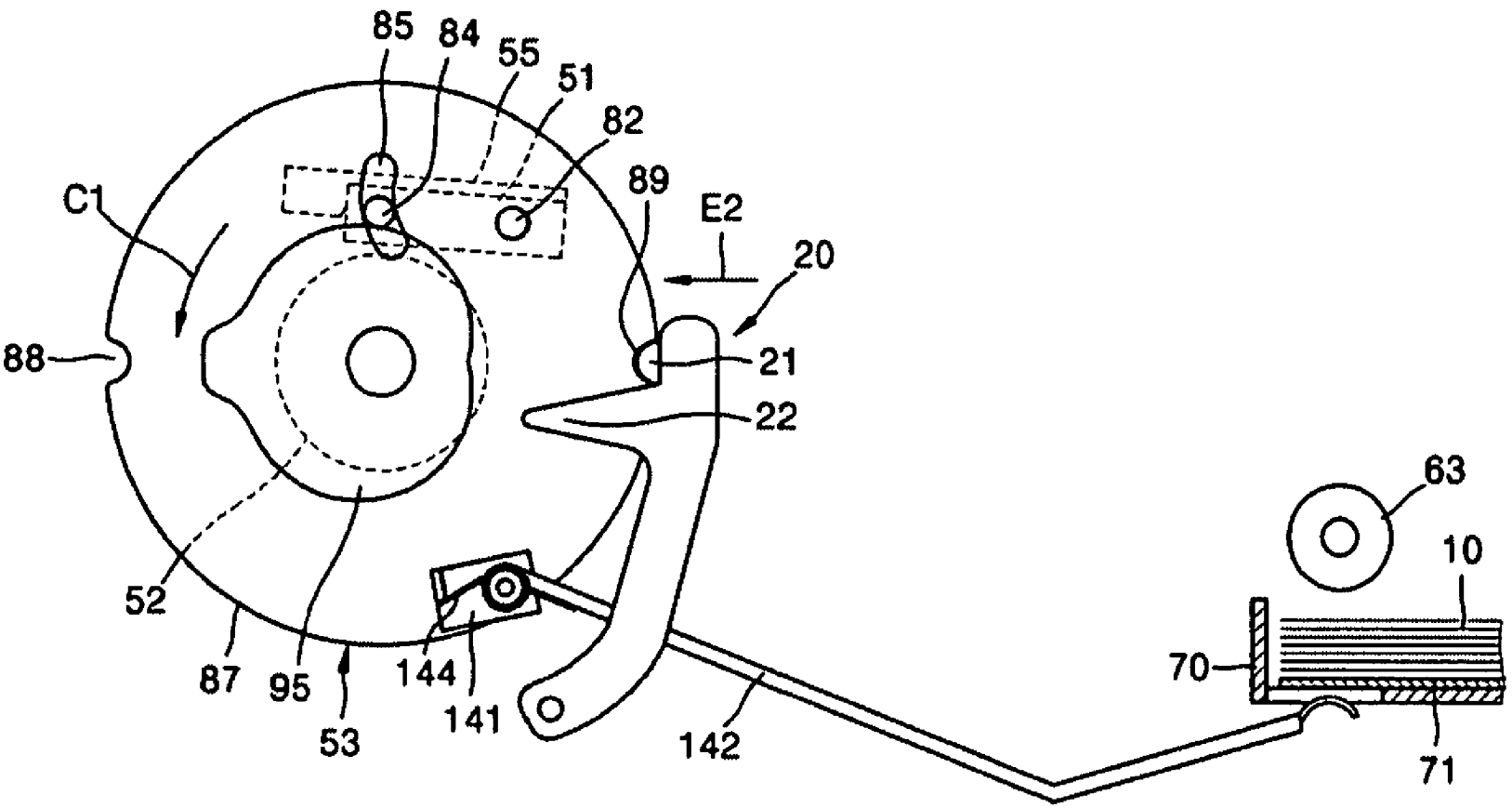

Now, to print on the second side M2 of the printing medium 10, the TPH 51 is transferred in the second position which is opposite to the second side M2 of the printing medium 10, as shown in FIG. 2. When the rotation cam 95 is rotated toward the direction C2 in a state shown in FIG. 8C, the third cam surface 97*c* and the stopper 98 push the snag 22 so that the locking member 20 is rotated toward a direction E1 as shown in FIG. 8D. As a result, the protrusion 21 is separated from the first joining notch 88 and the supporting bracket 53 is released to be able to rotate freely. Therefore, when the rotation cam 95 is continuously rotated toward the direction C2 and the second cam surface 97*b* pushes the cam lever 84, the supporting bracket 53 is rotated toward the direction C2, as shown in FIG. 8E, instead of the TPH 51 being pivoted. When a blocking state generated between the third surface 97*c* and the snag 22 is terminated, the locking member 20 is continuously in contact with the outer circumference 87 of the supporting bracket 53 by the elastic force of the second elastic member 25. Referring to FIG. 8F, when the supporting bracket 53 is rotated by about 180 degrees, the locking member 20 is rotated toward a direction E2 by the elastic force of the second elastic member 25 and the protrusion 21 is joined with the second joining notch 89. The supporting bracket 53 is locked so that it does not rotate anymore. The TPH 51 is positioned in the first open position, wherein is separated from the platen roller 52 by the first gap.

Figure 8G:
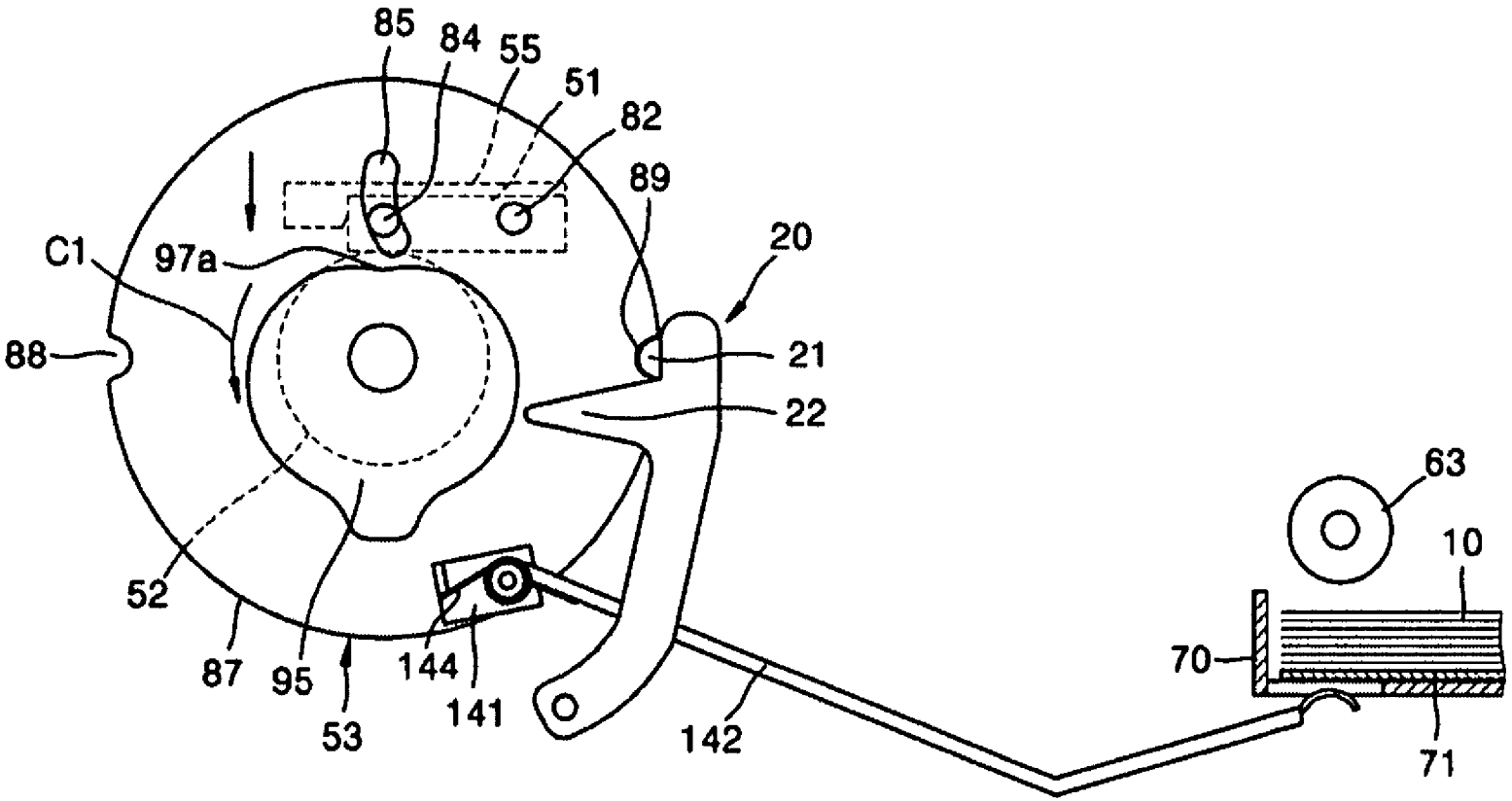

The transfer unit 40 and the discharging unit 60 transfer the printing medium 10 in the first direction A1. Before the terminal end of the printing medium 10 is completely out of the transfer unit 40, the transfer unit 40 is halted. The TPH 51 is in the opposite position with respect to the second side M2 of the printing medium 10. The rotation cam 95 is rotated toward the direction C1 in a state shown in FIG. 8F. Since the protrusion 21 of the locking member 20 is joined with the second joining notch 89, the supporting bracket 53 is not rotated. The cam lever 84 faces the first cam surface 97*a*. The TPH 51 is rotated around the hinge hole 82 by the elastic force of the first elastic member 83 so that it is positioned in the contact position wherein the printing medium 10 is pushed toward the platen roller 52, as shown in FIG. 8G. Here, the first surface 97*a* and the cam lever 84 are preferably separated from each other. The transfer unit 40 transfers the printing medium 10 in the second direction A2. The TPH 51 prints an image by heating the first side M1 of the printing medium 10. The discharging unit 60 discharges the printing medium 10 on which the image is printed on both sides thereof.

When the duplex printing is completed, the rotation cam 95 is rotated toward the direction C1. The third cam surface 97*c* pushes the snag 22 so that the locking member 20 is able to rotate toward a direction E1 as shown in FIG. 7D. As a result, the protrusion 21 is separated from the second joining notch 89 and the supporting bracket 53 is released in a state where is able to rotate freely. Therefore, when the rotation cam 95 is continuously rotated toward the direction C1 and the second cam surface 97*b* pushes the cam lever 84, the supporting bracket 53 is rotated toward the direction C1, instead of separating the TPH 51 from the platen roller 52. When the blocking state generated between the third cam surface 97*c* and the snag 22 is terminated, the locking member 20 is continuously in contact with the outer circumference 87 of the supporting bracket 53 by the elastic force of the second elastic member 25. When the supporting bracket 53 is rotated by about 180 degrees, the locking member 20 is rotated toward a direction E2 by the elastic force of the second elastic member 25 and the protrusion 21 is joined with the first joining notch 88. The supporting bracket 53 is locked so that it does not rotate anymore. In addition, the TPH 51 is returned to the first position as shown in FIG. 8A.

In the above-mentioned exemplary embodiment of the present invention, an image forming apparatus capable of duplex printing has been described. However, the unit for pivoting the TPH 51 to the contact position and the first and second open positions, the unit for transferring the knock-up plate 71 to the pick-up position and the stand-by position, and the unit for determining the motion of the rotation cam may also be used in an image forming apparatus where the TPH 51 is fixedly installed opposite to the first side M1 of the printing medium 10. In this case, the hinge hole 82 may be included in the side-plates 102 and 102*a* of the frame 100.

The cam motor 104 can rotate the rotation cam 95 so that the first, second, and third cam surfaces 97*a*, 97*b*, and 97*c* face the cam lever 84, thereby moving the TPH 51 to the first and second open positions.

Accordingly, a thermal type image forming apparatus according to the present invention has following advantages.

First, when a single rotation cam is used for pivoting a TPH to a contact position and first and second open positions, gaps between the TPH and a platen roller may be different at both sides of the TPH. However, in the present invention, a pair of rotation cams are used so that the gaps (the first and second gaps) are constant at the both sides of the TPH. Therefore, in the process of supplying the printing medium between the TPH and the platen roller, the possibility of generating a medium jam can be reduced.

Second, a phase of the rotation cam can be initiated with a simple structure. Therefore, operational errors of the image forming apparatus, which are generated as phase errors accumulate, can be prevented.

Third, the platen roller is rotated by a contact force of the printing medium. Thus, a power connection structure for transferring the printing medium can be simplified.

Fourth, a knock-up plate is selectively lifted toward a pick-up roller by being engaged with a pivoting operation of the TPH in association with the rotation cam. Thus, an electric clutch or the like for controlling a driving force of the pick-up roller can be omitted, which has an advantage in improving price competitiveness.

Fifth, by using a single TPH, a low-cost image forming apparatus capable of duplex color printing can be realized.

Sixth, by using the rotation cam for pivoting the TPH, the TPH is transferred to be opposite to both sides of the printing medium. Thus, a very compact image forming apparatus can be realized.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A thermal type image forming apparatus comprising:

a platen roller;

a thermal printing head (TPH) unit facing the platen roller and pivoting to contact or separate from the platen roller;

a first elastic member which elastically biases the TPH unit toward the platen roller;

a pair of cam levers provided on both sides of the TPH unit; and a pair of rotation cams which contact the pair of cam levers and allows the TPH unit to pivot according to a rotation angle thereof, wherein the TPH unit rotates around the platen roller to be disposed in first and second positions where the TPH unit faces the first and second surfaces of a printing medium, and to initiate a phase of the pair of rotation cams, at least one of the pair of the rotation cams includes a stopper which is caught by the cam lever at a position where the TPH unit is separated from the platen roller by a maximum gap.

2. The apparatus according to claim 1, further comprising:

a cam motor for rotating the rotation cam; and a metering means for detecting a current applied to the cam motor, wherein the phase of the rotation cam is initiated when a current value rises when the stopper is caught by the cam lever.

3. The apparatus according to claim 1, further comprising:

a cam motor rotating the rotation cam; and an encoder generating a signal proportional to a rotation angle of the cam motor, wherein the phase of the rotation cam is initiated when the signal of the encoder is not generated when the stopper is caught by the cam lever.

4. The apparatus according to claim 1, further comprising:

a transfer unit for transferring a printing medium; and a driving motor for driving the transfer unit, wherein the platen roller is rotated by a contact force generated between the printing medium and the platen roller.

5. The apparatus according to claim 1, further comprising:

a pair of supporting brackets capable of rotating around the platen roller, the pair of supporting brackets pivotably supporting the TPH unit.

6. The apparatus according to claim 5, further comprising:

first and second joining notches formed in the supporting bracket;

a locking member for locking the supporting bracket by selectively joining with the first and second notches; and a second elastic member which allows the locking member to be elastically biased toward a joining direction of the first and second joining notches, wherein the rotation cam pushes the locking member so that the locking member is separated from the first and second joining notches.

7. The apparatus according to claim 6, wherein:

when the pair of rotating cams contacts the pair of cam levers and rotates in a condition where the locking member is separated from the first and second joining notches, the pair of supporting brackets rotates so that the TPH unit is transferred to the first and second positions where the TPH unit faces the first surface of the medium and the second surface facing thereto; and when the pair of rotating cams contacts the pair of cam levers and rotates in a state where the locking member is joined with the first and second joining notches, the TPH unit pivots.

8. The apparatus according to claim 1 further comprising:

a knock-up plate on which a the printing medium is placed;

a pick-up roller which picks up the printing medium, the pickup roller being separated from the printing medium;

a transfer unit for transferring the printing medium; and a driving motor for driving the transfer unit and the pick-up roller, wherein the knock-up plate is pivoted to a pick-up position where a medium loaded thereon contacts the pick-up roller and to a stand-by position where the medium is separated from the pick-up roller.

9. The apparatus according to claim 8, wherein the platen roller is rotated by a contact force generated between the printing medium and the platen roller.

10. The apparatus according to claim 9, wherein the TPH unit pivots toward a first open position to be separated from the platen roller by a first gap, and a second open position to be separated from the platen roller by a second gap which is greater than the first gap, and the knock-up plate is transferred to the pick-up position while the TPH unit pivots toward the second open position.

11. The apparatus according to claim 10, further comprising:

a first arm which rotates in contact with the TPH unit when the TPH unit pivots to the second open position;

a second arm which is pivoted by the first arm to lift the knock-up plate to the pick-up position; and another member which elastically joins the first and second arms.

12. The apparatus according to claim 10, further comprising:

a pair of supporting brackets capable of rotating around the platen roller, wherein the TPH unit is installed to be pivotable in the pair of supporting brackets.

13. The apparatus according to claim 12, further comprising:

first and second joining notches formed in the supporting bracket;

a locking member for locking the supporting bracket by selectively joining with the first and second notches; and a second elastic member which allows the locking member to be elastically biased toward a joining direction of the first and second joining notches, wherein the rotation cam pushes the locking member so that the locking member is separated from the first and second joining notches.

14. The apparatus according to claim 13, wherein when the pair of rotating cams contacts the pair of cam levers and rotates in a condition where the locking member is separated the first and second joining notches, the pair of supporting brackets rotates so that the TPH unit is transferred to the first and second positions facing the first surface of the medium and the second surface facing thereto; and when the pair of rotating cams contacts the pair of cam levers and rotates in a condition where the locking member is joined with the first and second joining notches, the TPH unit pivots.

15. A thermal type image forming apparatus comprising:

a platen roller;

a thermal printing head (TPH) unit facing the platen roller, the TPH being pivotable between a contact position where the TPH contacts the platen roller, a first open position where the TPH is separated from the platen roller by a first gap, and a second open position where the TPH is separated from the platen roller by a second gap which is greater than the first gap;

a pair of supporting brackets capable of rotating around the platen roller, the pair of supporting brackets pivotably supporting the TPH unit;

a pair of cam levers provided on both sides of the TPH unit;

a pair of rotation cams that contact the pair of cam levers and allow the TPH unit to pivot according to a rotation angle thereof;

a knock-up plate for supporting a printing medium, the knock-up plate being pivotable between a pick-up position and a stand-by position; and a pick-up roller for picking up the printing medium from the knock-up plate when the knock-up plate is in the pick-up position, the pick-up roller being separated from the printing medium in the stand-by position.

16. The apparatus according to claim 15, further comprising:

a first arm which rotates in contact with the TPH unit when the TPH unit pivots to the second open position;

a second arm which is pivoted by the first arm to lift the knock-up plate to the pick-up position; and an elastic member which elastically joins the first and second arms.

* * * * *